US006976408B2

(12) United States Patent
Chen

(10) Patent No.: US 6,976,408 B2
(45) Date of Patent: Dec. 20, 2005

(54) ANNULAR WRENCH

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 70 days.

(21) Appl. No.: 10/396,167

(22) Filed: Mar. 24, 2003

(65) Prior Publication Data

US 2004/0187648 A1 Sep. 30, 2004

(51) Int. Cl.[7] ..... B25B 13/46
(52) U.S. Cl. ..... 81/60; 81/58
(58) Field of Search ..... 81/60–63, 58, 81/177.5, 489, 177.6, 177.7, 177.8

(56) References Cited

U.S. PATENT DOCUMENTS 1,331,956 A * 2/1920 Cross ..... 81/60
2,758,493 A * 8/1956 Goldwater ..... 81/58.2
5,005,448 A * 4/1991 Main ..... 81/63
5,979,274 A * 11/1999 Hsieh ..... 81/60
6,253,648 B1 * 7/2001 Beery ..... 81/121.1
6,295,898 B1 * 10/2001 Hsieh ..... 81/177.8
6,516,689 B1 * 2/2003 Bates ..... 81/60

* cited by examiner

*Primary Examiner*—Boyer D. Ashley
*Assistant Examiner*—J Williams
(74) *Attorney, Agent, or Firm*—Alan D. Kamrath; Nikolai & Mersereau, P.A.

(57) ABSTRACT

An annular wrench includes a first ring for engagement with a hand, a second ring rotationally installed in the first ring for engagement with a tool bit, a one-way driving device arranged between the first ring and the second ring so that the first ring can drive the second ring in a direction through the one-way driving device, and a tab pivotally mounted on the first ring between a lying position and a standing position. In the standing position, the tab can be pressed for rotating the first ring.

19 Claims, 10 Drawing Sheets

ANNULAR WRENCH

BACKGROUND OF INVENTION

1. Field of Invention

The present invention relates to an annular wrench.

2. Related Prior Art

Taiwanese Patent Publication No. 242807 discloses a toolbox/wrench with a case 10 for containing tool bits and a cover 16 for covering the case 10. The case 10 defines a hole 11 for receiving a toothed shaft 20 and a recess 12 for receiving a toothed pawl 23. The hole 11 is communicated with the recess 12, thus allowing engagement of the toothed shaft 20 with the toothed pawl 23. The toothed shaft 20 defines a hexagonal hole 21 for receiving a hexagonal shank of a connecting rod 34. The connecting rod 34 defines a hexagonal hole. In a first mode of operation, the hexagonal hole defined in the connecting rod 34 receives a hexagonal shank of a screwdriver 32. In a second mode of operation, the connecting rod 34 is engaged with a socket 31 via a second connecting rod 33. The second connecting rod 33 includes a hexagonal shank and a square shank. The socket 31 defines a square hole and a hexagonal hole. The hexagonal shank of the second connecting rod 33 is inserted in the hexagonal hole defined in the connecting rod 34. The square shank of the second connecting rod 33 is inserted in the square hole defined in the socket 31. The hexagonal hole defined in the socket 31 receives a nut or a head of a bolt. However, the case 10 cannot directly drive a tool bit such as a screwdriver or a socket. Furthermore, it is difficult to exert a large torque with the casing 10.

The present invention is therefore intended to obviate or at least alleviate the problems encountered in the prior art.

SUMMARY OF INVENTION

It is an objective of the present invention to provide an annular wrench for direct engagement with a tool bit.

It is another objective of the present invention to provide an annular wrench with which a large torque can be exerted on a tool bit.

According to the present invention, an annular wrench includes a first ring for engagement with a hand, a second ring rotationally installed in the first ring for engagement with a tool bit, a one-way driving device arranged between the first ring and the second ring so that the first ring can drive the second ring in a direction through the one-way driving device, and a tab pivotally mounted on the first ring between a lying position and a standing position. In the standing position, the tab can be pressed for rotating the first ring.

Other ebjectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
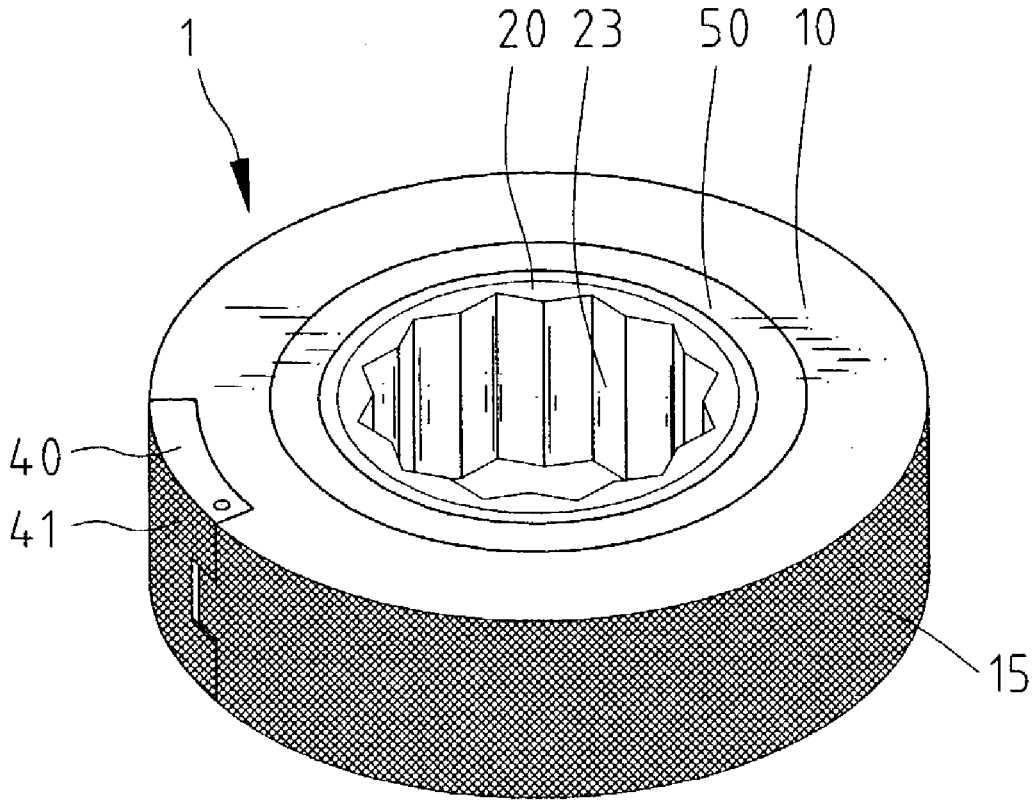
FIG. 1 is a perspective view of an annular wrench according to a first embodiment of the present invention.

Referring to FIG. 1, an annular wrench 1 according to a first embodiment of the present invention is shown.

Figure 2:
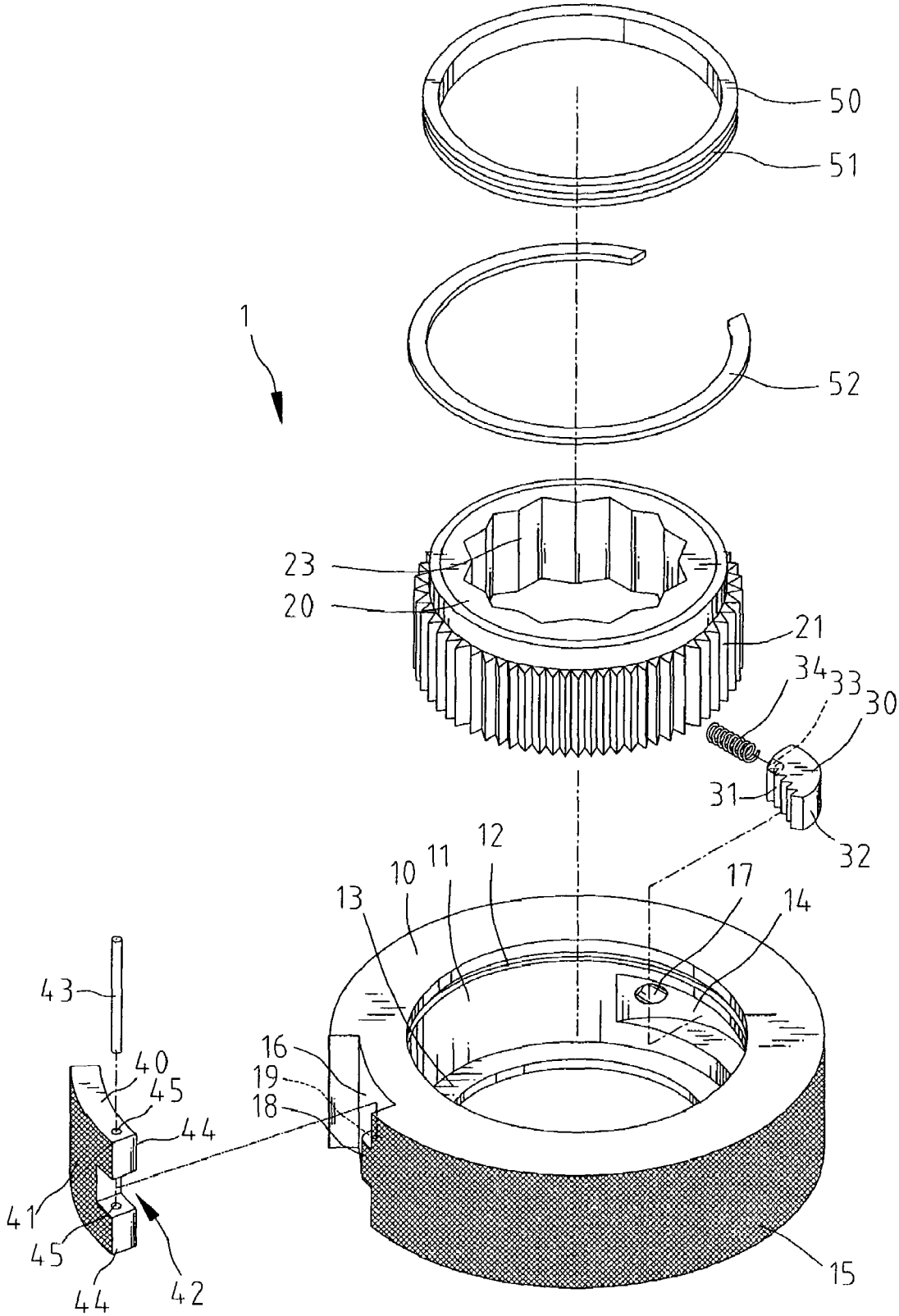
FIG. 2 is an exploded view of the annular wrench shown in FIG. 1.
Figure 3:
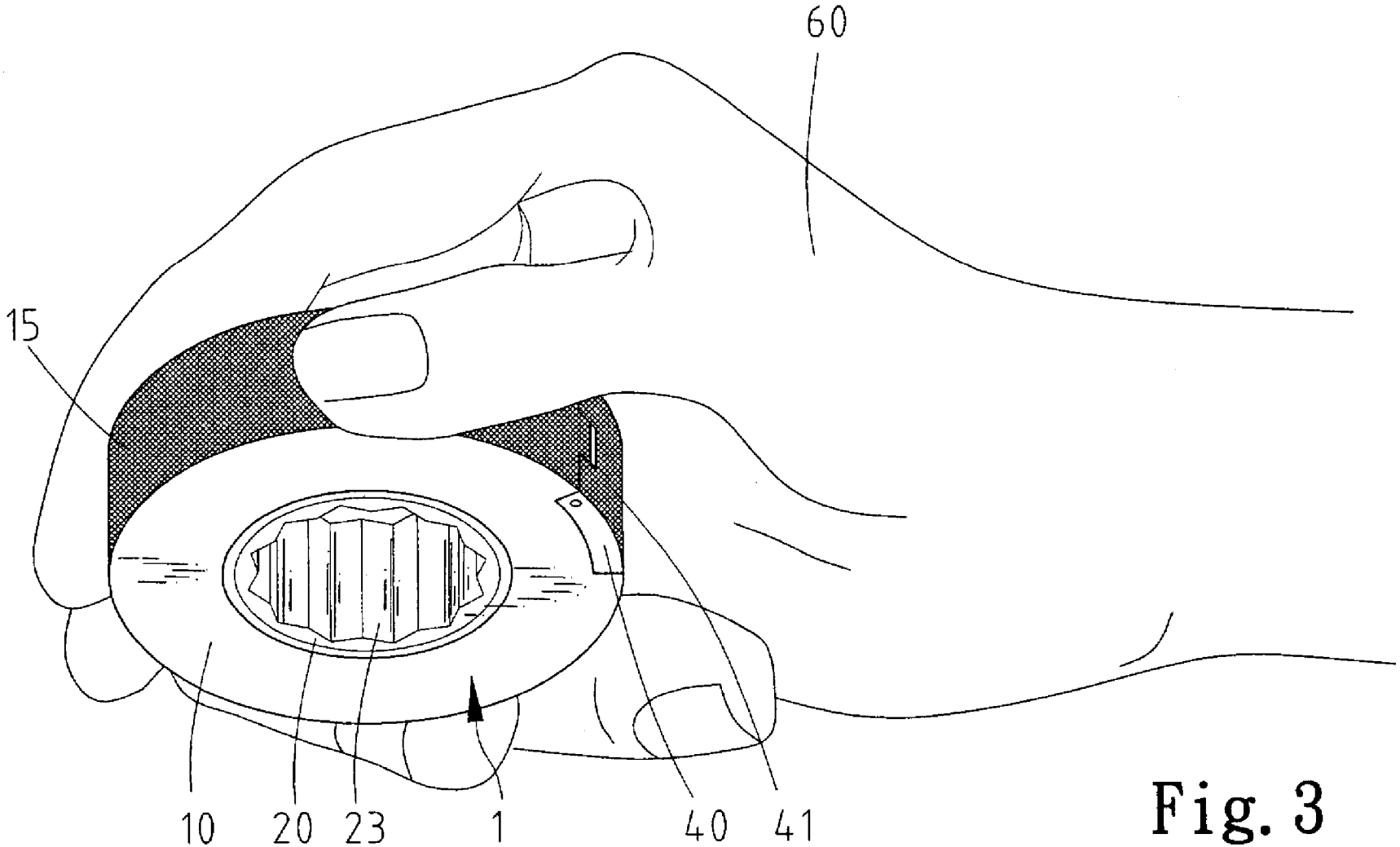
FIG. 3 shows a hand 60 holding the annular wrench shown in FIG. 1.

Referring to FIG. 2, the annular wrench 1 includes a first ring 10 and a second ring 20 rotationally installed in the first ring 10.

The first ring 10 defines a space 11. The first ring 10 includes an internal side and an external side. First ring 10 includes an annular groove 12 defined in the internal side thereof, an annular flange 13 formed on the internal side thereof, a first recess 14 defined in the internal side thereof, a second recess 17 communicated with the first recess 14, a rough surface 15 formed on the external side thereof, a recess 16 defined in the external side thereof and a lug 18 formed on the external side thereof in the recess 16. The lug 18 defines a hole 19.

A toothed pawl 30 includes a toothed face 31 formed on an internal side thereof, an arched surface 32 formed at a first end thereof, and a recess 33 defined in a second end thereof. A spring 34 includes a first end fit in the recess 33 and a second end inserted in the recess 17 while the toothed pawl 30 is put in the recess 14.

The second ring 20 includes a toothed surface 21 formed on an external side and a non-circular surface 23 formed on an internal side thereof. The second ring 20 is put in the space 11 so that the toothed surface 21 is engaged with the toothed face 31.

A ring 50 includes an annular groove 51 defined in an external side. A C-ring 52 includes an internal edge put in the annular groove 51 and an external edge put in the annular groove 12, thus retaining the second ring 20 in the first ring 10.

A tab 40 is pivotally mounted on the first ring 10. The tab 40 includes a rough surface 41 formed on an external side. The tab 40 includes a cutout 42 defined in an edge thereof, thus forming two separate lugs 44. Each of the lugs 44 defines a hole 45. A pin 43 is inserted in the holes 45 defined in the lugs 45 of the tab 41 and the hole 19 defined the lug 18. The tab 40 can be put in the recess 16 so that the rough surface 41 is in flush with the rough surface 15.

Figure 4:
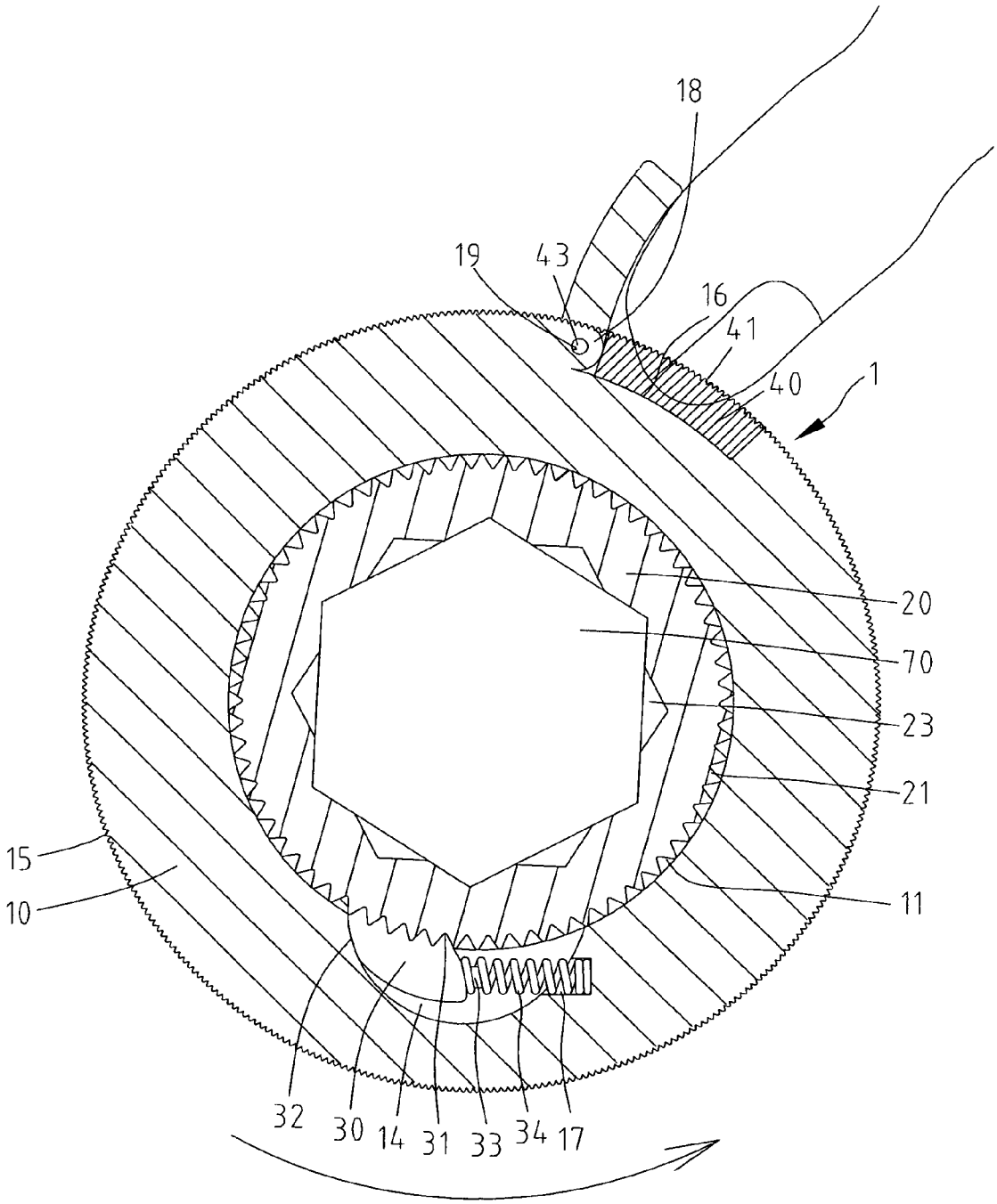
FIG. 4 is a cross-sectional view of the annular wrench shown in FIG. 1 for driving a tool bit in a direction.

Referring to FIG. 4, the tab 41 is pivoted from the recess 16 so that it can be pressed so as to rotate the first ring 11, the second ring 12 and a bolt 70 counterclockwise.

Figure 5:
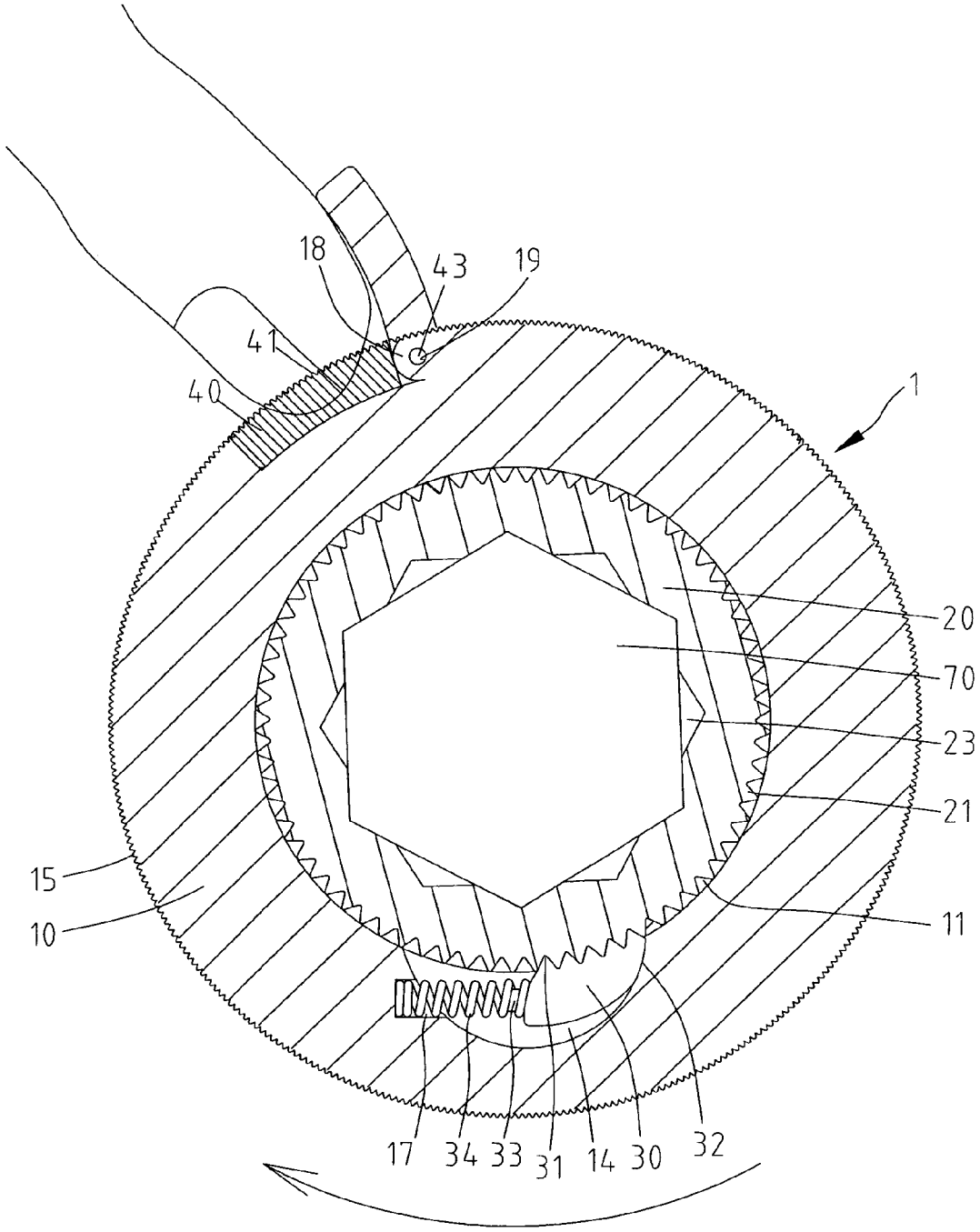
FIG. 5 is similar to FIG. 4 but showing the annular wrench for driving in a tool bit in an opposite direction.

Referring to FIG. 5, the annular wrench 1 is inverted. Thus, the tab 41 is pivoted from the recess 16 so that it can be pressed in order to rotate the first ring 10, the second ring 20 and the bolt 70 clockwise.

Figure 6:
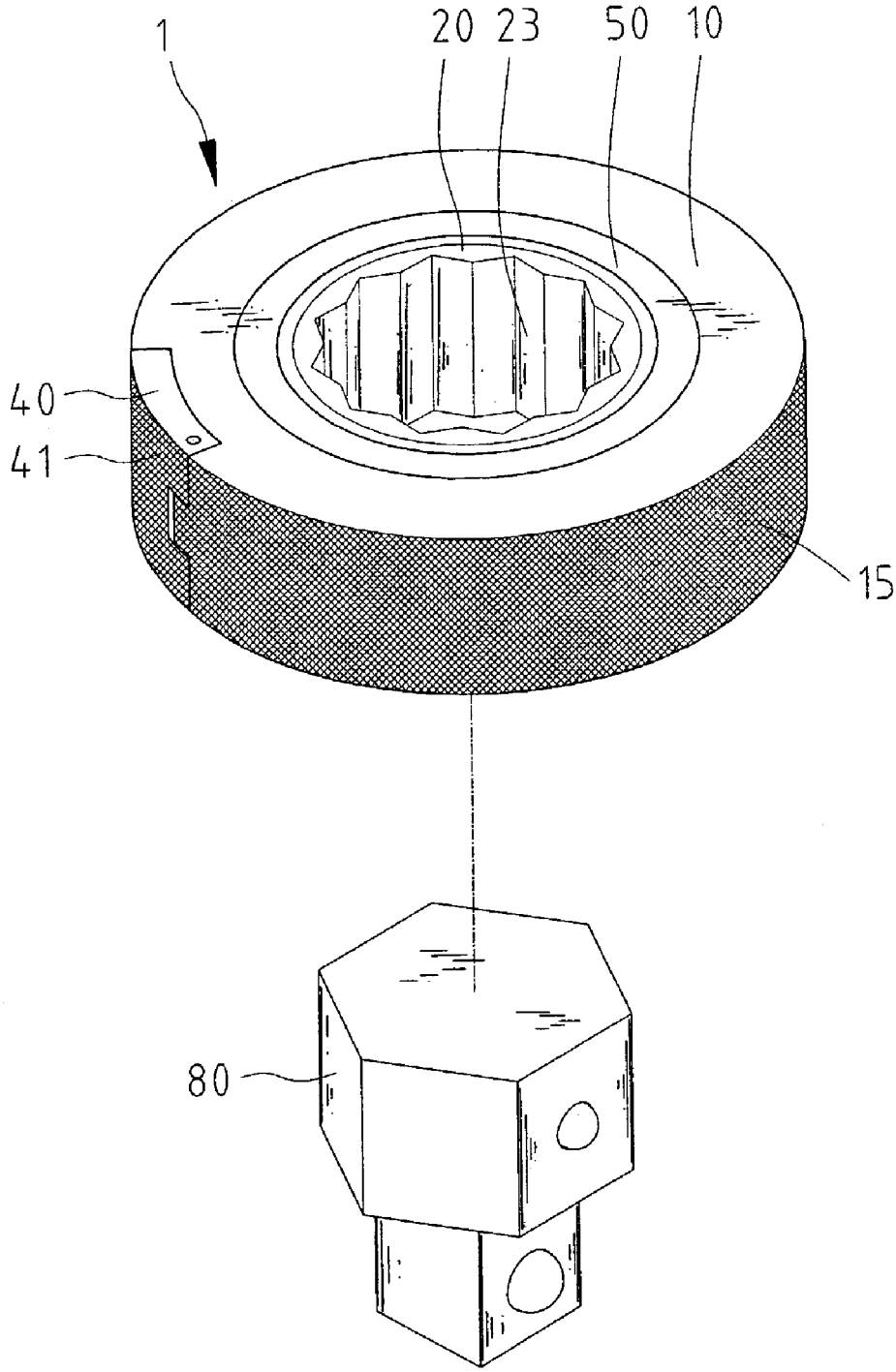
FIG. 6 is a perspective view of the annular wrench shown in FIG. 1 used together with a connecting rod.
Figure 7:
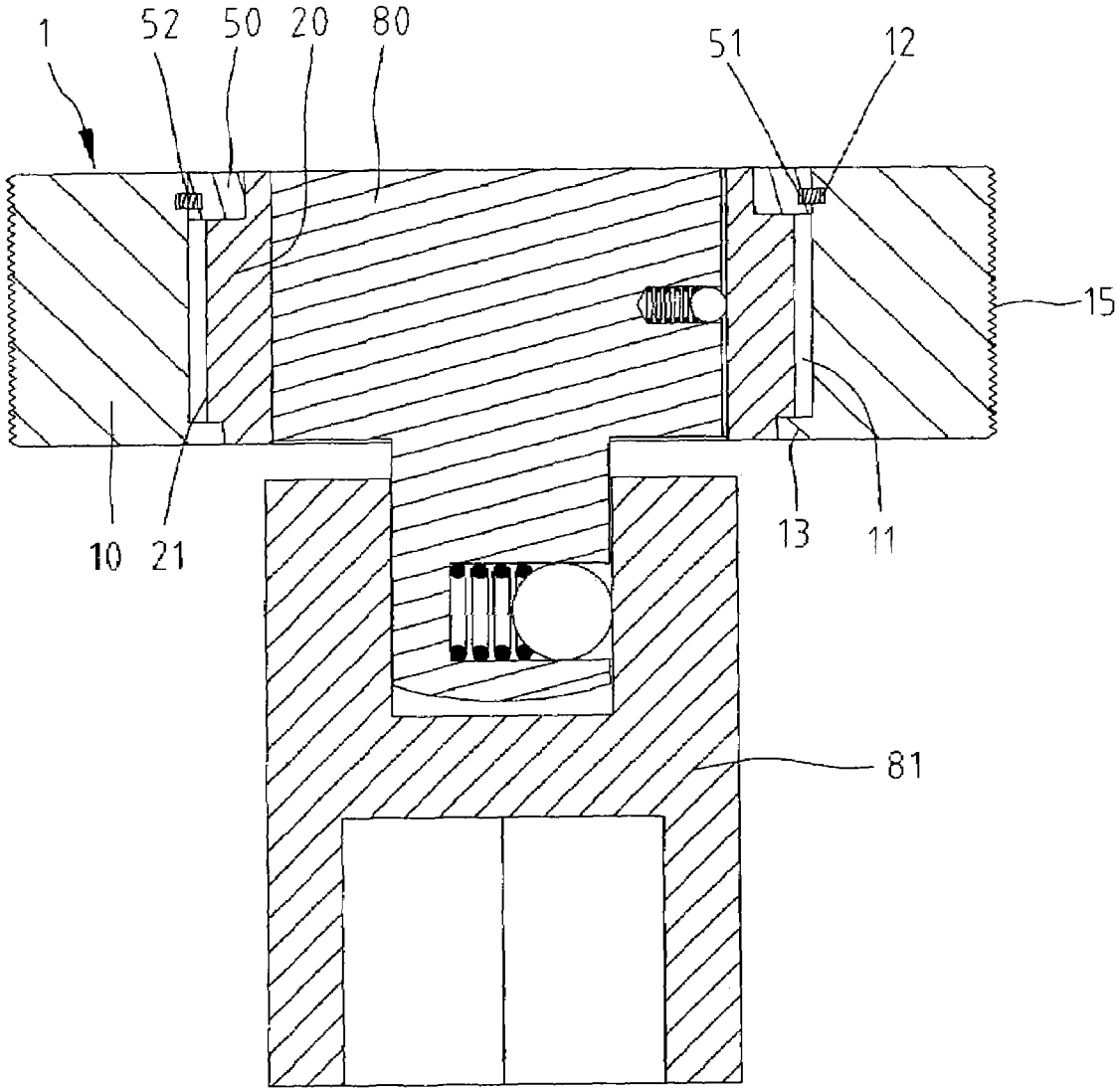
FIG. 7 is a cross-sectional view of the annular wrench and the connecting rod shown in FIG. 6 for engagement with a socket.

Referring to FIGS. 6 and 7, the annular wrench 1 is used together with a connecting rod 80. The connecting rod 80 includes a non-circular shank (not numbered) for engagement with the non-circular face 23 and a square shank (not numbered) for engagement with a square hole defined in a socket 81.

Figure 8:
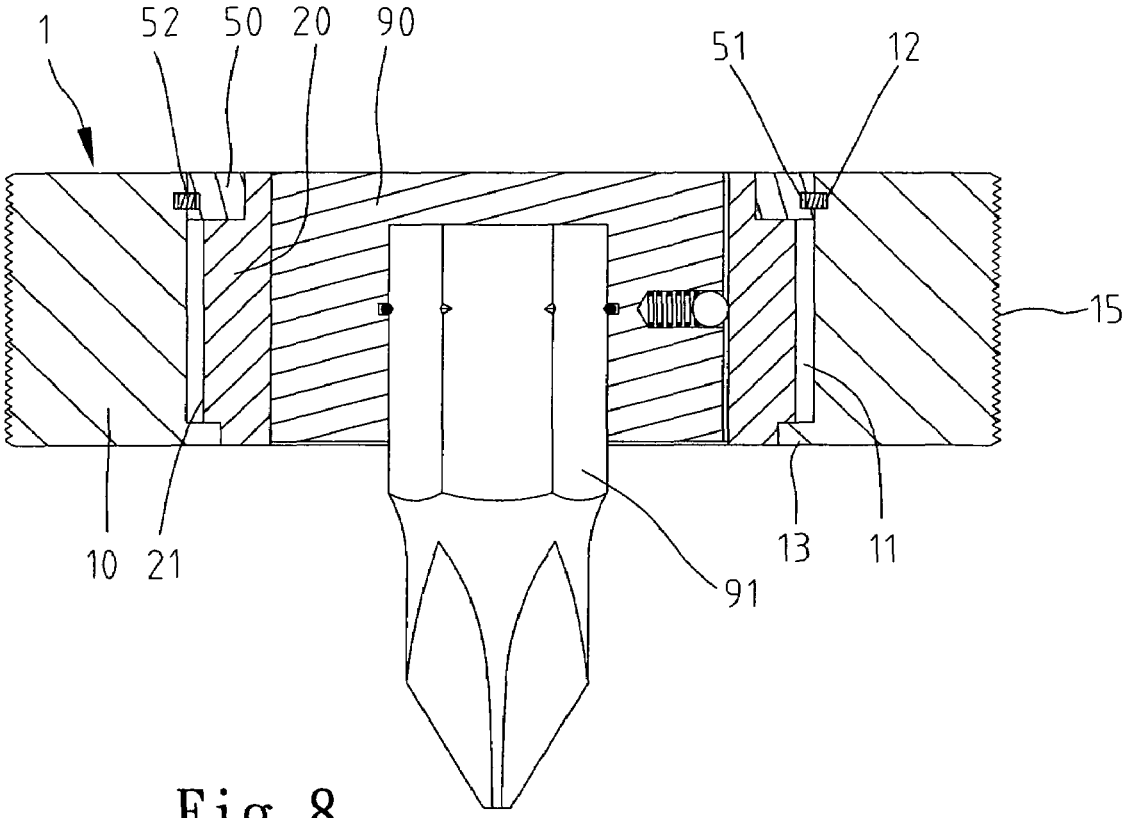
FIG. 8 is similar to FIG. 7 but showing the annular wrench engaged with a socket engaged with a screwdriver.

Referring to FIG. 8, the annular wrench 1 is engaged with a socket 90 engaged with a screwdriver 91. The socket 90 includes a non-circular external surface (not numbered) for engagement with the non-circular surface 23 and a non-circular internal surface (not numbered) for engagement with a non-circular shank (not numbered) of the screwdriver 91.

Figure 9:
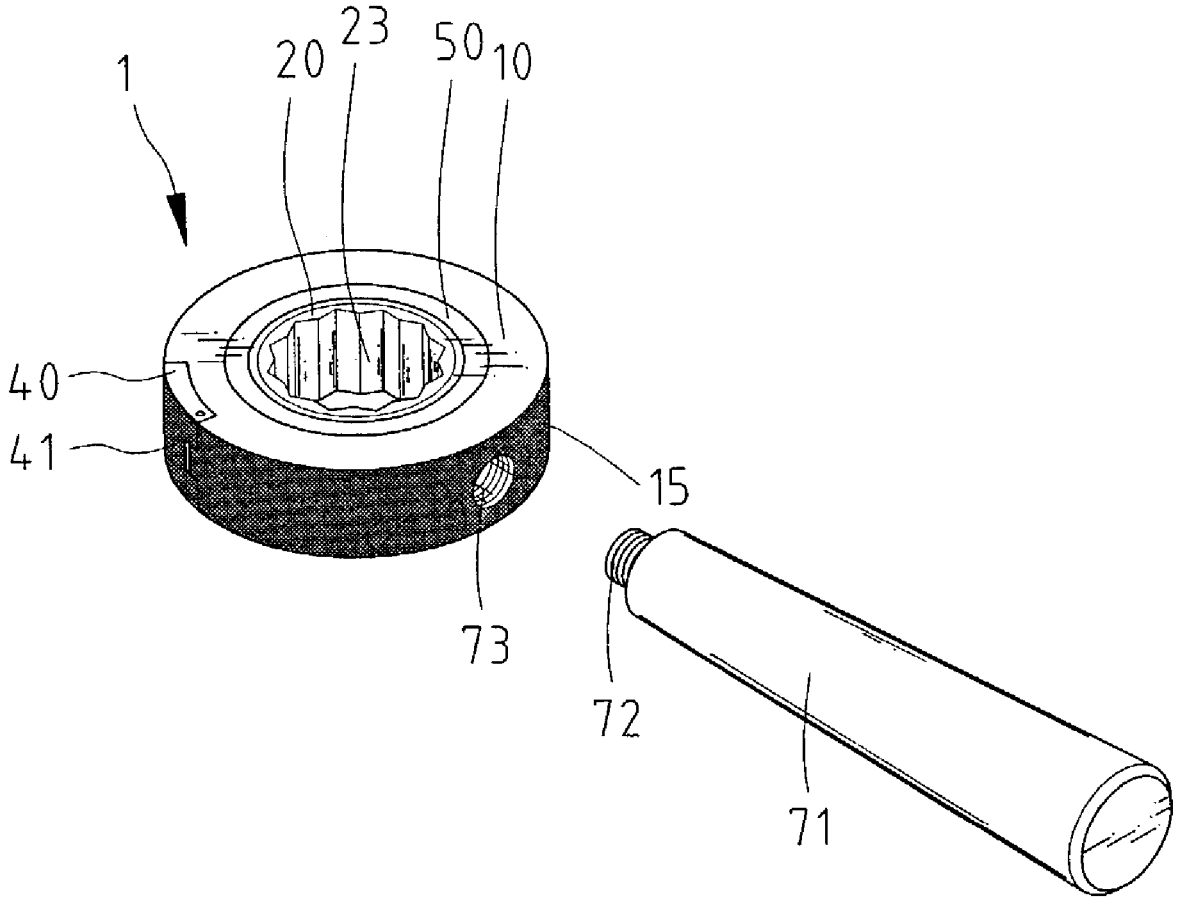
FIG. 9 is an exploded view of an annular wrench according to a second embodiment of the present invention.
Figure 10:
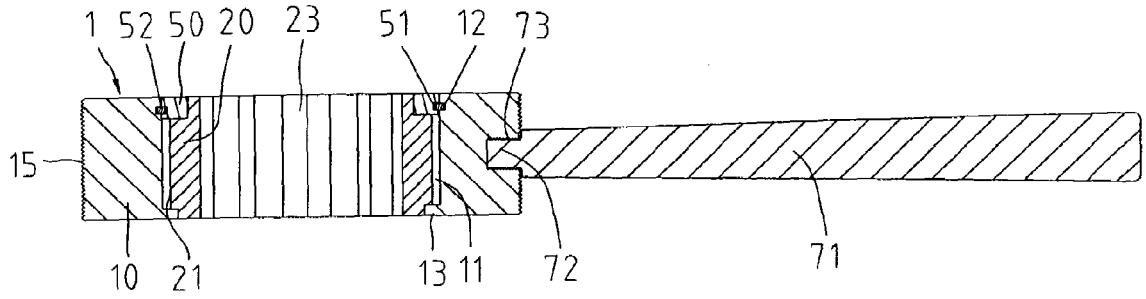
FIG. 10 is a cross-sectional view of the annular wrench shown in FIG. 9.

FIGS. 9 and 10 show an annular wrench according to a second embodiment of the present invention. The second embodiment is identical to the first embodiment except for including a handle 71 connected with the first ring 10. The handle 71 includes a threaded end 72 inserted in a threaded hole 73 defined in the first ring 10.

The present invention has been described through detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. An annular wrench including a first ring for engagement with a hand, a second ring rotationally installed in the first ring for engagement with a tool bit, a one-way driving device arranged between the first ring and the second ring so that the first ring can drive the second ring in a direction through the one-way driving device, and a tab pivotally mounted on the first ring between a lying position and a standing position where the tab can be pressed for rotating the first ring, with the tab in the lying position being concentric to the first ring and in the standing position extending radially from the first ring.

2. The annular wrench according to claim 1 wherein the first ring defines a central space for receiving the second ring.

3. The annular wrench according to claim 2 wherein the first ring includes an internal side and an external side.

4. The annular wrench according to claim 3 wherein the first ring includes a lug formed on the external side thereof, and the tab includes at least one lug formed thereof for pivotal connection with the lug of the first ring.

5. The annular wrench according to claim 3 including a pin inserted in a hole defined in the lug of the first ring and a hole defined in the lug of the tab.

6. The annular wrench according to claim 4 wherein the tab includes two lugs located beside the lug of the first ring.

7. The annular wrench according to claim 6 including a pin inserted in a hole defined in the lug of the first ring and a hole defined in each of the lugs of the tab.

8. The annular wrench according to claim 3 wherein the first ring includes a recess defined in the external side thereof for receiving the tab.

9. The annular wrench according to claim 1 wherein the tab includes a rough surface formed on an external side.

10. The annular wrench according to claim 3 wherein the one-way driving device includes a pawl and a spring both located in a recess defined in the internal side of the first ring so that the pawl is biased by the spring.

11. The annular wrench according to claim 10 wherein the second ring includes a toothed surface formed on an external side, and the pawl includes a toothed face formed on an internal side for engagement with the toothed surface of the second ring.

12. The annular wrench according to claim 3 including a C-ring with an external edge put in an annular groove defined in the internal side of the first ring, thus retaining the second ring in the first ring.

13. The annular wrench according to claim 12 including a ring with an external side defining an annular groove for receiving an internal edge of the C-ring, thus firmly retaining the second ring in the first ring.

14. The annular wrench according to claim 3 wherein the first ring includes an annular flange formed on the internal side thereof for supporting the second ring.

15. The annular wrench according to claim 1 including a handle removably and replaceably connected with the first ring.

16. The annular wrench according to claim 1 wherein the first ring includes an external side and includes a recess defined in the external side, with the tab in the lying position located in the recess.

17. The annular wrench according to claim 16 wherein the tab includes an external surface, with the external surface of the tab being contiguous with the external surface of the first ring in the lying position.

18. The annular wrench according to claim 17 wherein the external surfaces of the first ring and the tab are rough.

19. The annular wrench according to claim 1 with the first ring having an external surface having circular cross sections, with the tab in the standing position extending radially from the external surface.

* * * * *